US008499523B2

(12) United States Patent
Sawyers et al.

(10) Patent No.: US 8,499,523 B2
(45) Date of Patent: Aug. 6, 2013

(54) FRAME ASSEMBLY HAVING STILE AND RAIL TABS FOR COUPLING STILE AND RAIL MEMBERS TOGETHER

(75) Inventors: Jeffrey V. Sawyers, Rice Lake, WI (US); Brian Jensen, Cameron, WI (US); Joseph D. Isaacs, Cameron, WI (US); Ronald J. Pich, Cameron, WI (US)

(73) Assignee: Quanex Corporation, Houston, TX (US)

( * ) Notice: Subject to any disclaimer, the term of this patent is extended or adjusted under 35 U.S.C. 154(b) by 163 days.

(21) Appl. No.: 13/005,292

(22) Filed: Jan. 12, 2011

(65) Prior Publication Data

US 2011/0167753 A1 Jul. 14, 2011

Related U.S. Application Data

(60) Provisional application No. 61/335,932, filed on Jan. 13, 2010.

(51) Int. Cl.
*E04C 2/38* (2006.01)

(52) U.S. Cl.
USPC ..... 52/656.5; 52/656.6; 52/204.1

(58) Field of Classification Search
USPC ..... 52/656.5, 656.6, 658, 204.1
See application file for complete search history.

(56) References Cited

U.S. PATENT DOCUMENTS

| | | | | |
|---|---|---|---|---|
| 1,030,694 | A * | 6/1912 | Watson | 160/381 |
| 1,562,212 | A | 11/1925 | Fien | |
| 2,617,502 | A | 11/1952 | Kessler | |
| 2,651,393 | A | 9/1953 | Sylvan | |
| 4,021,988 | A | 5/1977 | Edeus et al. | |
| 4,494,354 | A | 1/1985 | Johnston | |
| 4,843,775 | A | 7/1989 | Armstrong et al. | |
| 5,520,475 | A | 5/1996 | Coolman et al. | |
| 5,581,953 | A | 12/1996 | Ruff | |
| 7,418,806 | B2 | 9/2008 | Martineau et al. | |

* cited by examiner

*Primary Examiner* — Basil Katcheves
(74) *Attorney, Agent, or Firm* — Howard & Howard Attorneys PLLC

(57) ABSTRACT

A frame assembly supports a fenestration article. The frame assembly comprises a stile member and a rail member coupled substantially transverse to the stile member. A stile tab extends axially from the stile member and a rail tab extends axially from the rail member. The stile tab is bent around the rail member and the rail tab is bent around the stile member for coupling the stile member to the rail member.

18 Claims, 14 Drawing Sheets

FRAME ASSEMBLY HAVING STILE AND RAIL TABS FOR COUPLING STILE AND RAIL MEMBERS TOGETHER

CROSS REFERENCE TO RELATED APPLICATION

This application claims priority to and all the advantages of U.S. Provisional Patent Application Ser. No. 61/335,932, which was filed on Jan. 13, 2010.

BACKGROUND OF THE INVENTION

1. Field of the Invention

The invention generally relates to a frame assembly and, more specifically, to a frame assembly for supporting a fenestration article.

2. Description of the Related Art

Frame assemblies for windows or doors, which support an article, such as screen cloth or a pane of glass, are known in the art and have been widely used by window manufacturers. Generally, the frame assemblies are disposed adjacent to an exterior side of the window or door. A typical frame assembly includes a pair of stile members and a pair of rail members. The stile and rail members are coupled together to form the frame assembly.

Typically, the stile and rail members are coupled together by a separate attachment component such as a fastener, an adhesive strip, and/or a press-fit cornerlock. The attachment member prevents separation between the stile and rail members. The use of the attachment member adds cost to manufacture the frame assemble due to the cost of the attachment member.

As an alternative to the attachment member, the rail member may have tabs extending from ends of the rail member. In such cases, the rail member is completely disposed within the stile member and the tab extends through a slot defined by the stile member. The formation of the slot in the stile members adds time and costs to manufacture the frame assembly. Additionally, greater care must be taken when coupling the stile and rail members to properly align the tab of the rail member with the slot of the stile member.

The tab on the rail member is then bent to engage the stile member and prevent separation between the stile and rail members. The cross-section of the rail member is not uniform over an entire length because the end of the rail member must be narrowed to allow the rail member to be received within the stile member. As such, the stile and rail members do not have uniform cross-sections thus increasing costs to manufacture the frame assembly because the stile and rail members must be formed independent of one another. Additionally, having the tab on the rail member extend through the stile member prevents the stile member and the rail member from having cross-sections of irregular shapes, such as architectural sections as is known in the art.

Furthermore, completely disposing the rail member within the stile member results in limited engagement between the stile and rail members when coupled together. For example, having the rail member completely within the stile member prevents the stile member from having tabs to engage the rail member. Therefore, only the tab on the rail member prevents separation of the stile and rail members in both a horizontal and a vertical directions. The limited engagement between the stile and rail members limits the ability of the frame assembly to resist separating when normal forces act on the frame assembly. Therefore, there remains a need to provide an improved frame assembly.

SUMMARY OF THE INVENTION AND ADVANTAGES

A frame assembly supports a fenestration article. The frame assembly comprises a stile member having an exterior wall and an interior wall opposite the exterior wall. The frame assembly also comprises a rail member coupled substantially transverse to the stile member. The rail member has an exterior wall and an interior wall opposite the exterior wall of the rail member. A stile tab extends axially from the stile member. The stile tab is planar with the interior wall of the stile member. A rail tab extends axially from the rail member. The rail tab is planar with the exterior wall of the rail member. The stile tab is bent around the interior wall of the rail member for coupling the stile member to the rail member. Additionally, the rail tab is bent around the exterior wall of the stile member for coupling the rail member to the stile member.

The bending of the stile tab around the interior wall of the rail member and bending the rail tab around the exterior wall of the stile member prevents the stile member and the rail member from separating from each other. The bending of the stile tab and the rail tab also eliminates the need for a separate attachment component to couple the stile member and the rail member together. Elimination of the separate attachment component minimizes cost and time to manufacture the frame assembly.

BRIEF DESCRIPTION OF THE DRAWINGS

Advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
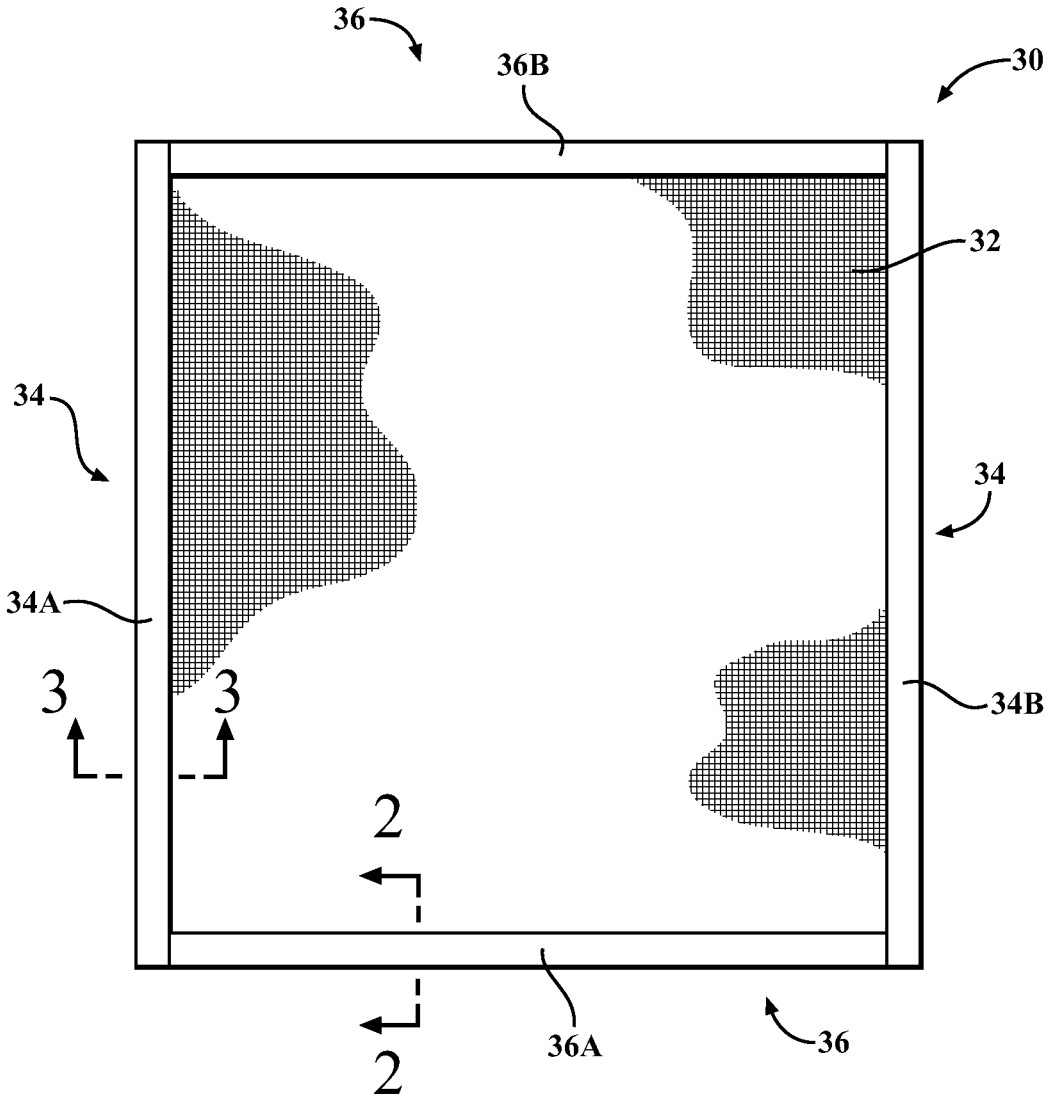
FIG. 1 is a front view of a frame assembly having a stile member and a rail member supporting a fenestration article.

Referring to the Figures, wherein like numerals indicate corresponding parts throughout the several views, a frame assembly is generally shown at 30. With reference to FIG. 1, the frame assembly 30 typically supports a fenestration article 32, such as a screen cloth, a glass pane, and/or a plastic panel. However, it should be understood that the frame assembly 30 may support any desired article other than the fenestration article 32. Typically, the frame assembly 30 is disposed adjacent an opening defined by a structure, such as a building or house for covering the opening.

The frame assembly 30 comprises at least one stile member 34 and at least one rail member 36. Generally, the rail member 36 is coupled substantially transverse to the stile member 34. Said differently, the coupling of the rail member 36 to the stile member 34 defines an angle of 90 degrees between the stile member 34 and the rail member 36. It is to be appreciated that the stile member 34 and the rail member 36 may be made from any suitable material, such as metal or plastic. It is also to be appreciated that the stile member 34 and the rail member 36 may be formed by any suitable process, such as molding, roll forming, extruding, and/or bending.

Typically, the frame assembly 30 includes a first stile member 34A and a second stile member 34B spaced from the first stile member 34A. Additionally, the frame assembly 30 typically includes a first rail member 36A and a second rail member 36B spaced from the first rail member 36A. When present, each of the rail members 36A, 36B are coupled substantially traverse to each of the stile members 34A, 34B thereby defining a rectangular configuration of the frame assembly 30. It is to be appreciated that the frame assembly 30 may define other configurations, such as triangular and pentagonal by varying the number of stile members 24 and/or the number of the rail members 26 provided in the frame assembly 30.

In embodiments where the first and second stile members 34A, 34B are present and the first and second rail members 36A, 36B are present, the stile members 34A, 34B are typically mirror images of each other and the rail members 36A, 36B are typically mirror images of each other. As such, for simplicity, only one of the stile members 34A, 34B and one of the rail members 36A, 36B are described below and hereinafter are referred to as the stile member 34 and the rail member 36.

Figure 2:
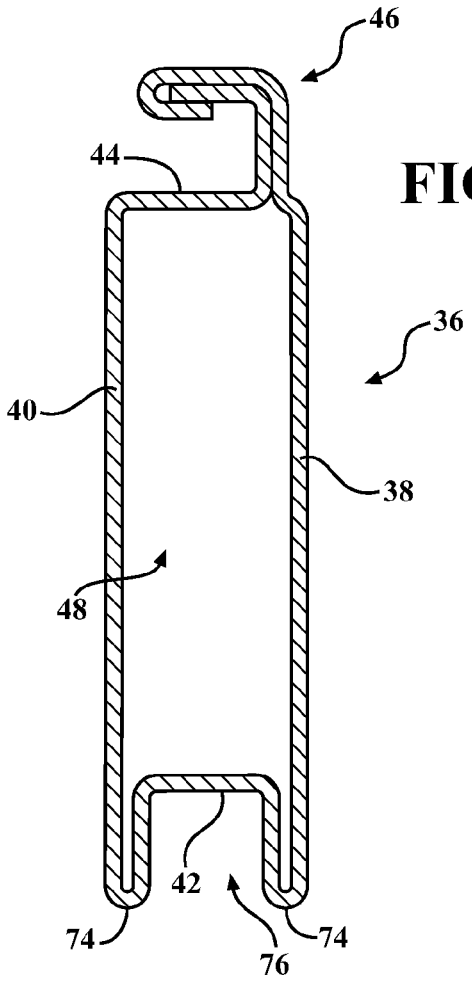
FIG. 2 is a cross-sectional view of the rail member taken along line 2-2 of FIG. 1.
Figure 3:
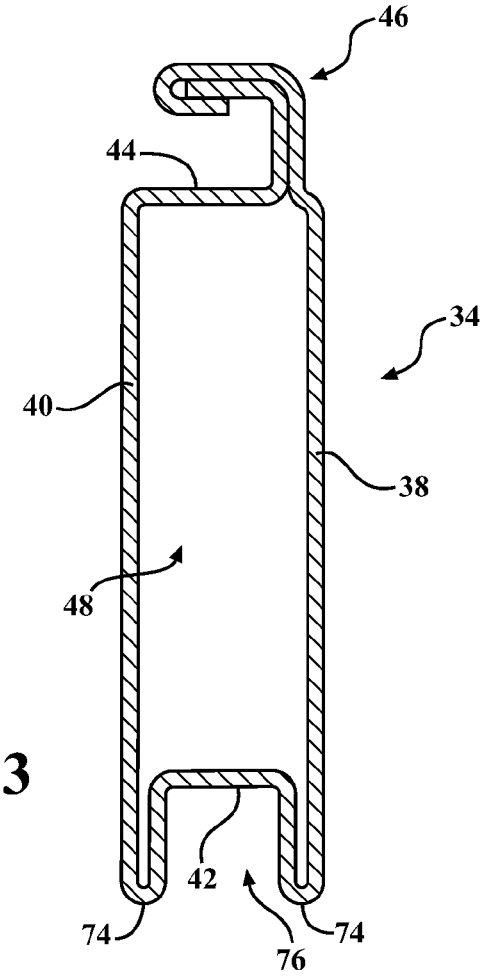
FIG. 3 is a cross-sectional view of the stile member taken along line 3-3 of FIG. 1.

With reference to FIGS. 2 and 3, each of the stile member 34 and the rail member 36 has a cross-section. Typically, the cross-section of the stile member 34 is generally similar to the cross-section of the rail member 36. As such, common features between the stile member 34 and the rail member 36 are indicated by the same reference numeral. The stile member 34 and the rail member 36 may be formed together as a single member and subsequently cut into two to form the stile member 34 and the rail member 36. Said differently, both the stile member 34 and rail member 36 may be cut from a common piece of stock because the cross-sections of the stile member 34 and the rail member 36 are similar. Forming the stile member 34 and the rail member 36 from the common piece of stock minimizes time to manufacture the frame assembly 30 because the stile member 34 and the rail member 36 do not have to be formed independent of one another. Additionally, having the stile member 34 and the rail member 36 with the similar cross-sections allows the stile member 34 and the rail member 36 to have cross-sections of irregular shapes, such as architectural sections as is known in the art.

Each of the stile member 34 and the rail member 36 has an exterior wall 38 and an interior wall 40 opposite the exterior wall 38. Typically, the interior wall 40 of the stile member 34 and the rail member 36 face the structure when the frame assembly 30 is disposed on the structure. Furthermore, the exterior wall 38 of the stile member 34 and the rail member 36 are visible from an exterior of the structure when the frame assembly 30 is disposed on the structure.

Each of the stile member 34 and the rail member 36 further include an outer wall 42 and an inner fastening wall 44 opposite the outer wall 42. Both the outer wall 42 and the inner fastening wall 44 are disposed between the interior wall 40 and the exterior wall 38. Generally, the outer wall 42 of the stile member 34 and the rail member 36 defines a periphery of the frame assembly 30. Additionally, the fenestration article 32 is coupled to the inner fastening wall 44 of each of the stile member 34 and the rail member 36. For example, a flange 46 may be coupled to and extend from the inner fastening wall 44 of each of the stile member 34 and the rail member 36 for receiving the fenestration article 32 to couple the fenestration article 32 to the frame assembly 30. However, it is to be appreciated that the fenestration article 32 may be secured to the inner fastening wall 44 of the stile member 34 and the rail member 36 by other methods. Additionally, it is to be appreciated that the flange 46 may be integral with the inner fastening wall 44 or the flange 46 may be a discrete component relative to the stile member 34 and the rail member 36.

The exterior wall 38, the interior wall 40, the outer wall 42, and the inner fastening wall 44 collectively define the cross-section of each of the stile member 34 and the rail member 36. The cross-section of the stile member 34 and the rail member 36 has a general rectangular configuration. It is to be appreciated that the cross-section of the stile member 34 and the rail member 36 may be other configurations other than the general rectangular configuration. The stile member 34 and the rail member 36 each have an interior 48 that is typically hollow. However, it is to be appreciated that the interior 48 of the stile member 34 and the rail member 36 may contain a filler, such as an insulating material or a stiffening material.

Figure 4:
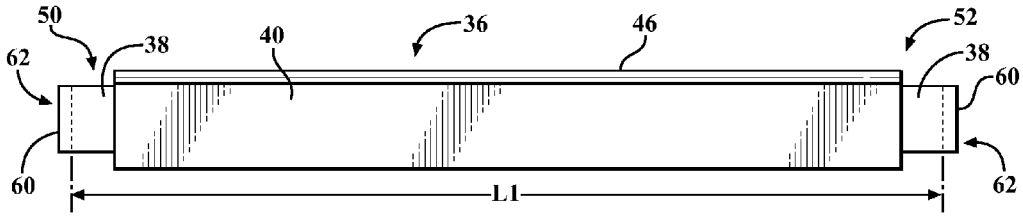
FIG. 4 is a front view of the rail member of FIG. 1.
Figure 5:
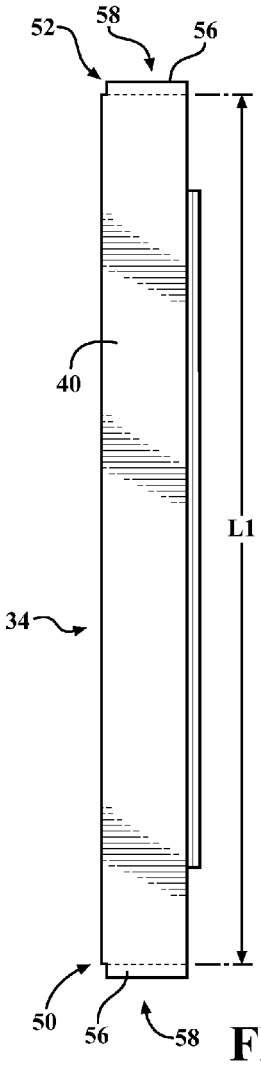
FIG. 5 is a front view of the stile member of FIG. 1.

With reference to FIGS. 4 and 5, the stile member 34 and the rail member 36 each have a first end 50 and a second end 52 that are open for allowing access to the interior 48 of the stile member 34 and the rail member 36. The stile member 34 and the rail member 36 are cut to a length L1, which is defined between the first end 50 and the second end 52 of both the stile member 34 and the rail member 36. It is to be appreciated that the length L1 of the stile member 34 may be the same as, or different from the length L1 of the rail member 36.

A stile tab 56 extends axially from each of the ends 50, 52 of the stile member 34. The stile tab 56 is planar with the interior wall 40 of the stile member 34. More specifically, the stile tab 56 is a continuation of the interior wall 40 of the stile member 34 and extends from the first end 50 of the stile member 34 to a stile tab end 58 along the length L1 of the stile member 34. Said differently, the interior wall 40 of the stile member 34 extends beyond the first end 50 and the second end 52 of the stile member 34 to define the stile tab 56 at the first end 50 of the stile member 34 and the stile tab 56 at the second end of the stile member 34, respectively. The stile tab 56 may be formed by cutting the first end 50 of the stile member 34 to remove a length of the exterior wall 38, the outer wall 42, and the inner fastening wall 44 thereby leaving the interior wall 40 of the stile member 34 intact to define the stile tab 56.

A rail tab 60 extends axially from the rail member 36 with the rail tab 60 planar with the exterior wall 38 of the rail member 36. More specifically, the rail tab 60 is a continuation of the exterior wall 38 of the rail member 36 and extends from the first end 50 of the rail member 36 to a rail tab end 62 along the length L1 of the rail member 36. Said differently, the exterior wall 38 of the rail member 36 extends beyond the first end 50 and the second end 52 of the rail member 36 to define the rail tab 60 at the first end 50 of the rail member 36 and the rail tab 60 at the second end 52 of the rail member 36, respectively. It should be appreciated that the stile tab 56 and the rail tab 60 are typically similar to one another except that the stile tab 56 extends from the interior wall 40 of the stile member 34 and the rail tab 60 extends from the exterior wall 38 of the rail member 36. The rail tab 60 may be formed by cutting the first end 50 of the rail member to remove a length of the interior wall 40, the outer wall 42, and the inner fastening wall 44 thereby leaving the exterior wall 38 of the rail member 36 intact to define the rail tab 60.

Figure 6:
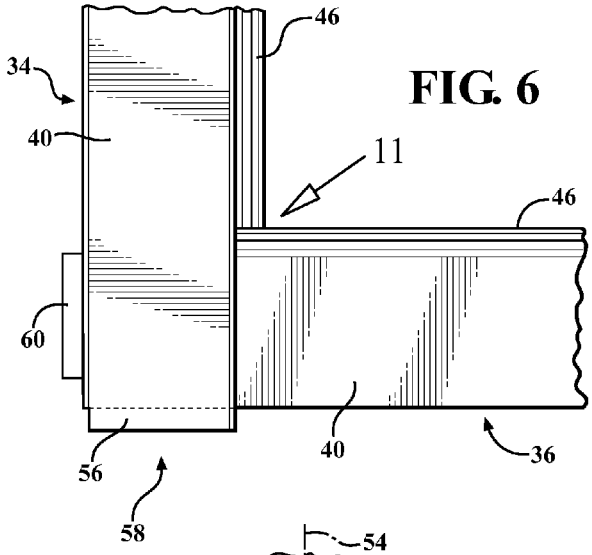
FIG. 6 is a front view of a portion of the frame assembly of FIG. 1 showing the stile member coupled to the rail member with a stile tab extending beyond the rail member and a rail tab extending beyond the stile member.
Figure 7:
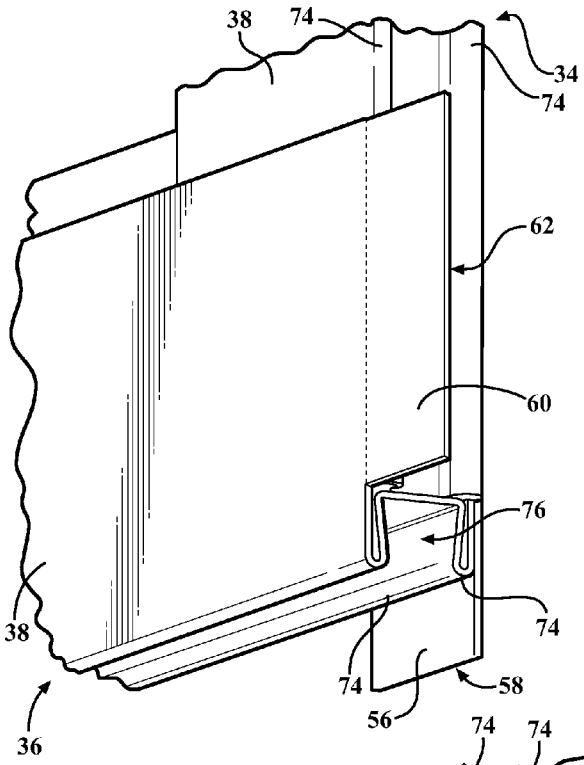
FIG. 7 is a perspective view of a portion of the frame assembly of FIG. 1 showing the stile member coupled to the rail member with the stile tab extending beyond the rail member and the rail tab extending beyond the stile member.
Figure 8:
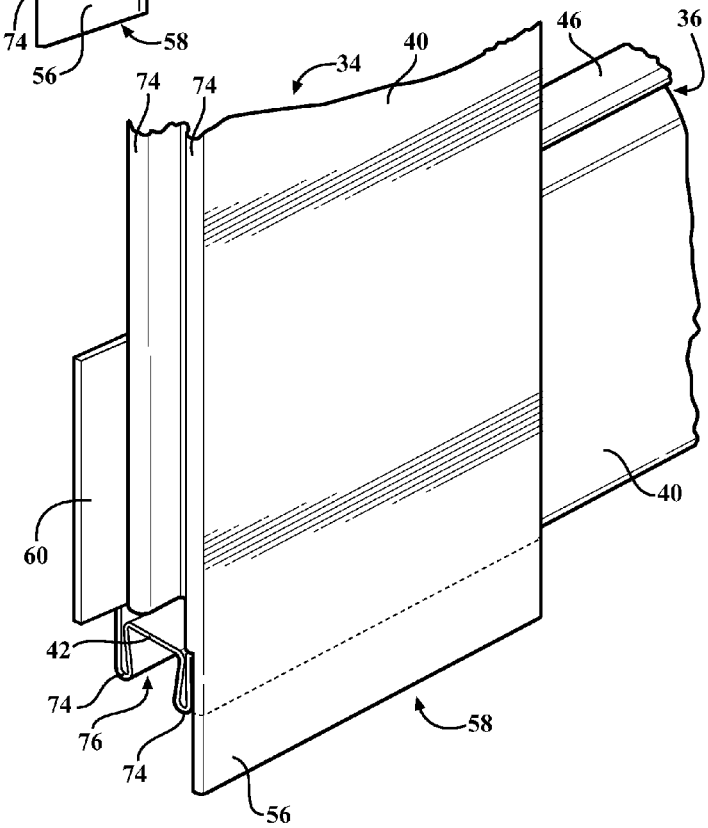
FIG. 8 is another perspective view of a portion of the frame assembly of FIG. 1 showing the stile member coupled to the rail member with the stile tab extending beyond the rail member and the rail tab extending beyond the stile member.
Figure 9:
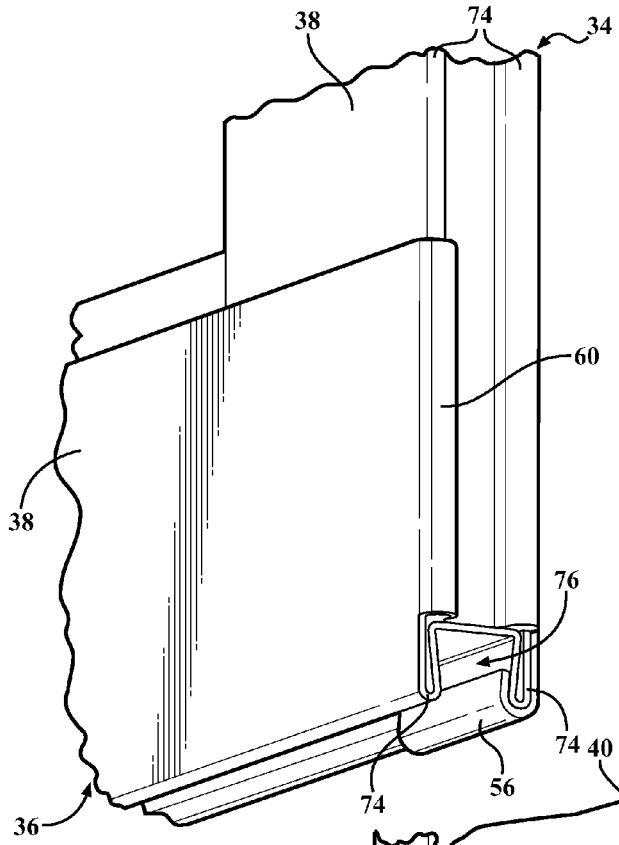
FIG. 9 is a perspective view of a portion of the frame assembly of FIG. 1 showing the stile tab of the stile member bent around the interior wall of the rail member and the rail tab of the rail member bent around the exterior wall of the stile member.
Figure 10:
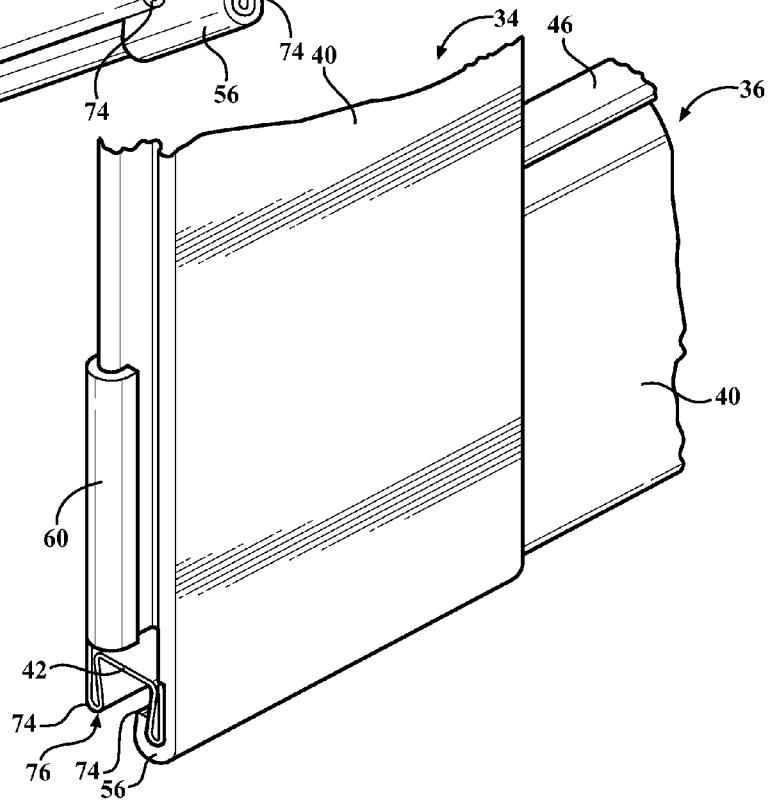
FIG. 10 is another perspective view of a portion of the frame assembly of FIG. 1 showing the stile tab of the stile member bent around the interior wall of the rail member and the rail tab of the rail member bent around the exterior wall of the stile member.

With reference to FIGS. 6-8, when the stile member 34 and the rail member 36 are coupled together, the stile tab 56 extends beyond the outer wall 42 of the rail member 36 and the rail tab 60 extends beyond the outer wall 42 of the stile member 34. With reference to FIGS. 9 and 10, the stile tab 56 is bent around the interior wall 40 of the rail member 36 for coupling the stile member 34 to the rail member 36. Said differently, the stile tab 56 is forced around the interior wall 40 of the rail member such that the stile tab 56 wraps around part of the rail member 36. Additionally, the rail tab 60 is bent around the exterior wall 38 of the stile member 34 for coupling the rail member 36 to the stile member 34. Said differently, the rail tab 60 is forced around the exterior wall 38 of the stile member 34 such that the rail tab 60 wraps around part of the stile member 34.

The stile tab 56 and the rail tab 60 prevent separation between the stile member 34 and the rail member 36 when normal forces, such as torsional, tensional, and/or compression forces act on the frame assembly 30. For example, the bending of the stile tab 56 around the rail member 36 prevents vertical separation between the stile member 34 and the rail member 36. Said differently, the stile tab 56 is bent around part of the rail member 36 such that the rail member 36 is pinched between the stile tab 56 and the stile member 34, which prevents the rail member 36 from separating from the stile member 34. Likewise, the bending of the rail tab 60 around the stile member 34 prevents horizontal separation between the rail member 36 and the stile member 34. Said differently, the rail tab 60 is bent around part of the stile member 34 such that the stile member 34 is pinched between the rail tab 60 and the rail member 36, which prevents the stile member 34 from separating from the rail member 36. The stile tab 56 and the rail tab 60 allow the stile member 34 and the rail member 36 to be coupled together easily, quickly and inexpensively without the use of fasteners, glues or press-fit cornerlocks.

Figure 11:
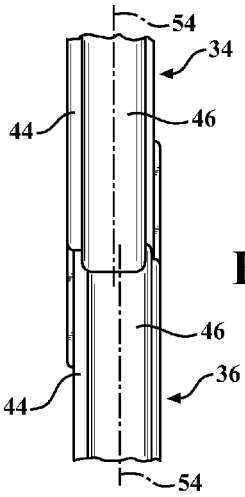
FIG. 11 is a view of a portion of the frame assembly taken in the direction of arrow 11 of FIG. 8 showing a centerline of an inner fastening surface of the stile member that is offset from a centerline of an inner fastening surface of the rail member.

With reference to FIG. 11, the inner fastening wall 44 of each of the stile member 34 and the rail member 36 defines a centerline 54, which extends between the first end 50 and the second end 52 along the length L1 of the stile member 34 and the rail member 36. When the stile member 34 and the rail member 36 are coupled together, the centerline 54 of the stile member 34 is offset from the centerline 54 of the rail member 36. Offsetting the centerline 54 of the stile member 34 and the centerline 54 of the rail member 36 allows the interior wall 40 of the stile member 34 to continue beyond the rail member 36 to form the stile tab 56. Additionally, offsetting the centerline 54 of the stile member 34 and the centerline 54 of the rail member 36 allows the exterior wall 38 of the rail member 36 to continue beyond the stile member 34 to form the rail tab 60. As such, neither the stile member 34 nor the rail member 36 are fully disposed within one another because the interior wall 40 of the stile member 34 remains outside of the interior 48 of the rail member 36 and the exterior wall 38 of the rail member 36 remains outside of the interior 48 of the stile member 34.

With reference to FIGS. 12-17, the stile member 34 and the rail member 36 typically nest with one another when the stile member 34 and the rail member 36 are coupled together. Said differently, the stile member 34 and the rail member 36 interlock with each other when the stile member 34 and the rail member 36 are coupled together. The stile member 34 and the rail member 36 may interlock such that a portion of the stile member 34 is disposed within the interior 48 of the rail member 36 and/or a portion of the rail member 36 is disposed within the interior 48 of the stile member 34. As such, a method of manufacturing the frame assembly 30 includes the step of inserting the portion of the exterior wall 38 of the stile member 34 into the interior 48 of the rail member 36 such that the stile tab 56 extends beyond the rail member 36. Additionally, the method of manufacturing the frame assembly 30 also includes the step of inserting the portion of the interior wall 40 of the rail member 36 into the interior 48 of the stile member 34 such that the rail tab 60 extends beyond the stile member 34. It is to be appreciated that the step of inserting the stile member 34 and the step of inserting the rail member 36 may be performed simultaneously.

Generally, a notch 64 may be formed in at least one of the stile member 34 or the rail member 36 for allowing the stile member 34 and the rail member 36 to nest with each other. Said differently, the notch 64 is defined by at least one of the stile member 34 or the rail member 36 for allowing the portion of the stile member 34 to be disposed within the interior of the 48 the rail member 36 and/or for allowing the portion of the rail member 36 to be disposed within the interior 48 of the stile member 34.

The nesting of the stile member 34 and the rail member 36 imparts strength to the joint of the frame assembly 30 for preventing the stile member 34 and the rail member 36 from separating from one another when the normal forces act on the frame assembly 30. It is to be appreciated that when both the stile member 34 and the rail member 36 define the notch 64, the notch 64 of the stile member 34 is referred to as a first notch 64A and the notch 64 of the rail member 36 is referred to as a second notch 64B.

Figures 12, 13:
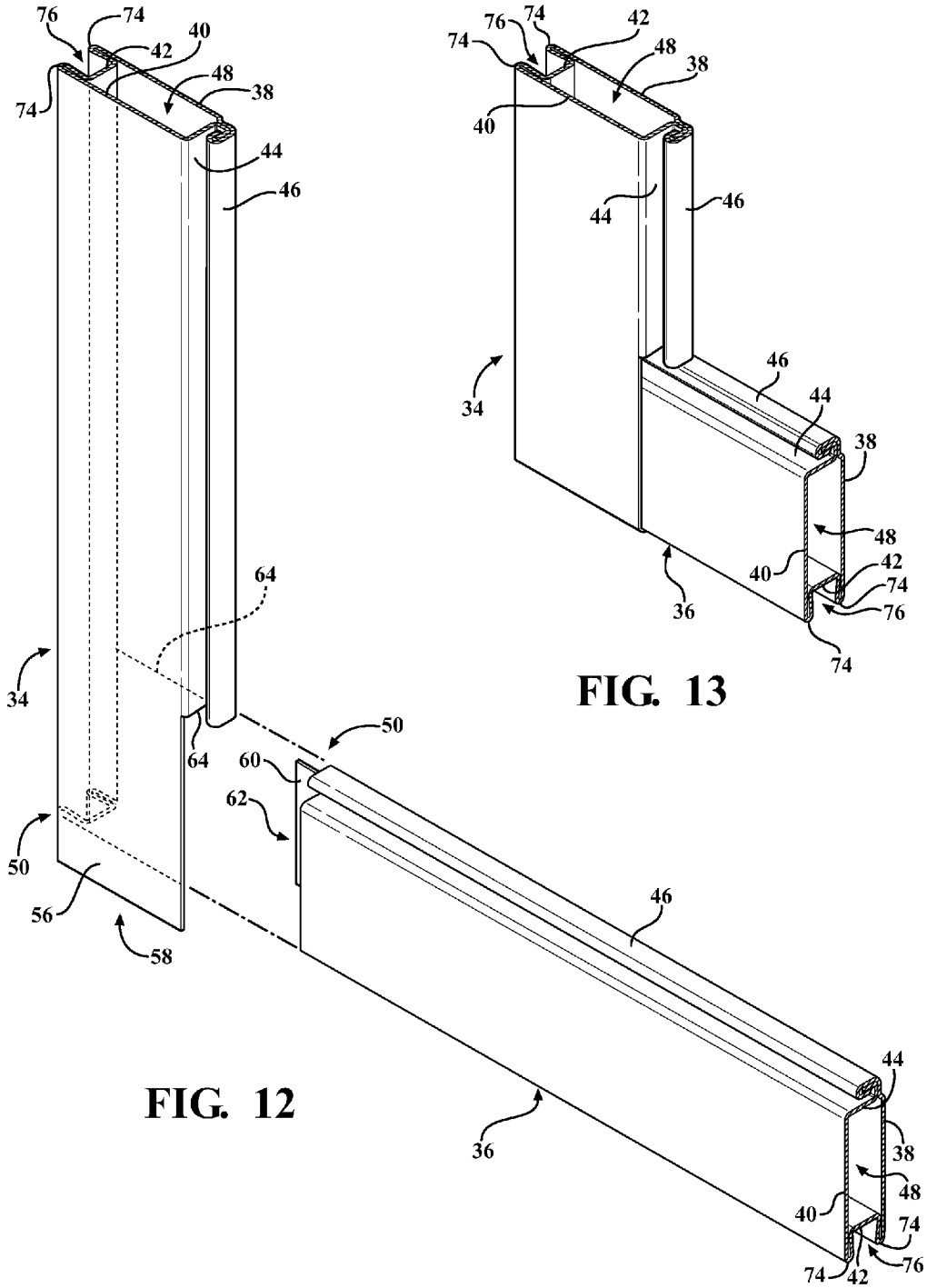
FIG. 12 is a perspective view of a portion of the frame assembly of FIG. 1 showing the stile member spaced from the rail member with the stile member defining a notch.
FIG. 13 is a perspective view of a portion of the stile member and rail member of FIG. 12 showing the stile member coupled to the rail member.
Figures 14, 15:
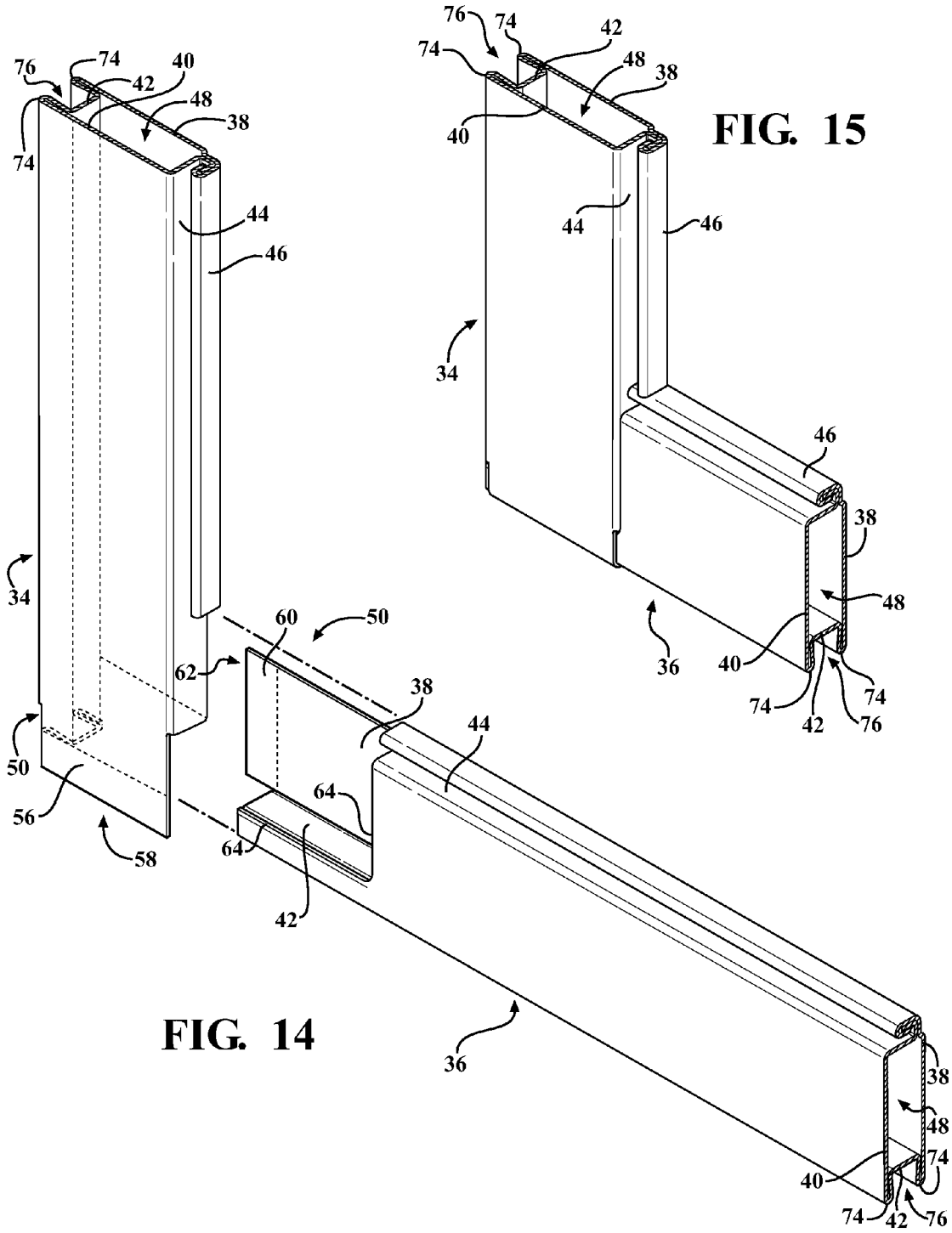
FIG. 14 is a perspective view of a portion of the frame assembly of FIG. 1 showing the stile member spaced from the rail member with the rail member defining a notch.
FIG. 15 is a perspective view of a portion of the stile member and the rail member of FIG. 14 showing the stile member coupled to the rail member.
Figures 16, 17:
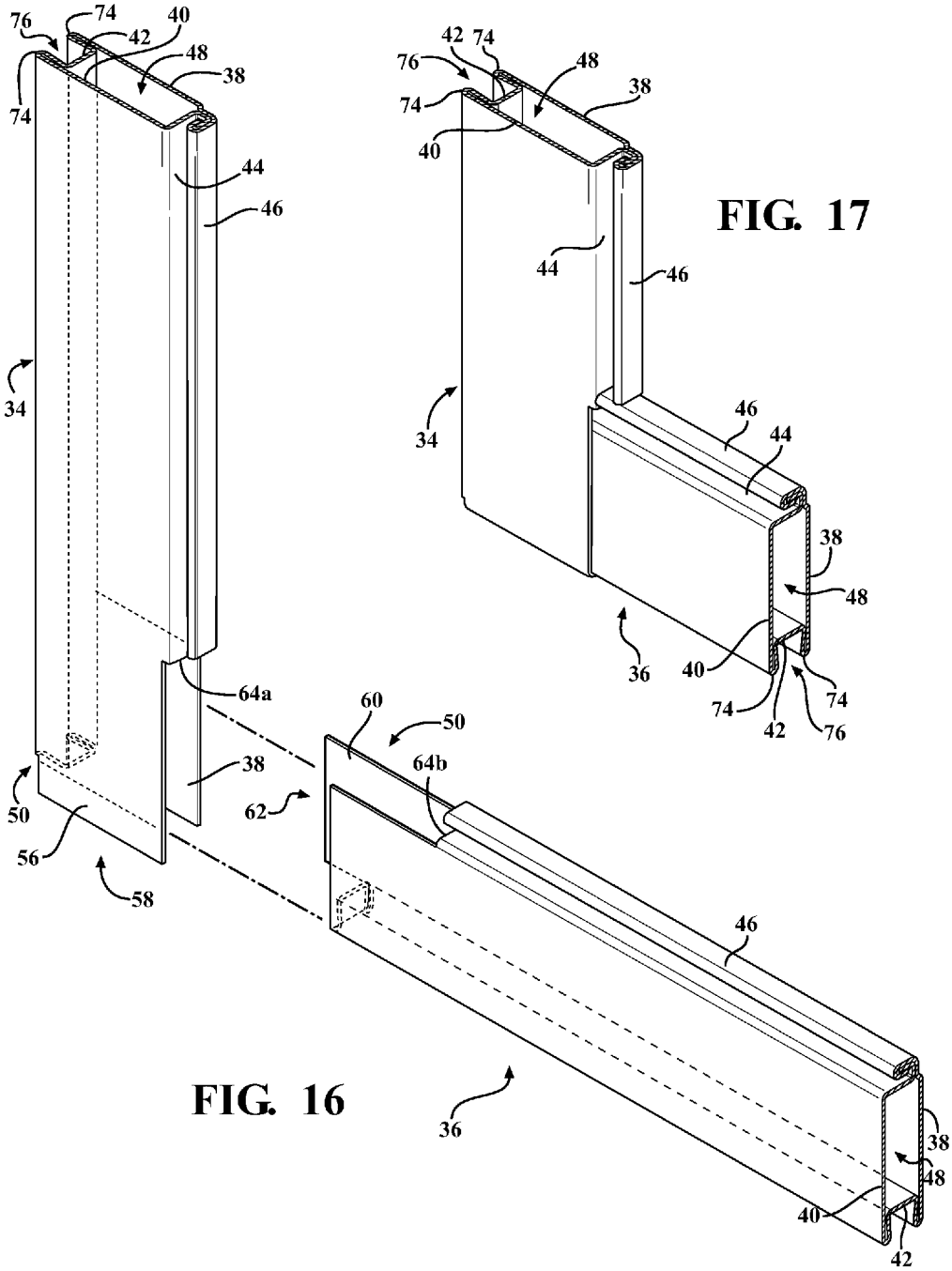
FIG. 16 is a perspective view of a portion of the frame assembly of FIG. 1 showing the stile member spaced from the rail member with the stile member defining a first notch and the rail member defining a second notch.
FIG. 17 is a perspective view of a portion of the stile member and the rail member of FIG. 16 showing the stile member coupled to the rail member.

With reference to FIGS. 12 and 13, the notch 64 may be and defined by at least the exterior wall 38 and the inner fastening wall 44 of the stile member 34 for allowing the portion of the rail member 36 to be disposed within the interior 48 of the stile member 34. In such an embodiment, at least both the interior wall 40 and the inner fastening wall 44 of the rail member 36 are disposed within the interior 48 of the stile member 34. Alternatively, with reference to FIGS. 14 and 15, the notch 64 may be defined by at least the interior wall 40 and the inner fastening wall 44 of the rail member 36 for allowing the portion of the stile member 34 to be disposed within the interior 48 of the rail member 36. In such an embodiment, at least both the exterior wall 38 and the inner fastening wall 44 of the stile member 34 are disposed within the interior 48 of the rail member. Furthermore, with reference to FIGS. 16 and 17, the first notch 64A may be defined by at least the inner fastening wall 44 of the stile member 34 for allowing the portion of the rail member 36 to be disposed within the interior 48 of the stile member 36 and the second notch 64B may be defined by at least the inner fastening wall 44 of the rail member 36 for allowing the portion of the stile member 34 to be disposed within the interior 48 of the rail member 36. In such an embodiment, at least the exterior wall 38 of the stile member 34 is disposed within the interior 48 of the rail member and a portion of the interior wall 40 of the rail member 36 is disposed within the interior 48 of the stile member 34. It is to be appreciated that the stile member 34 and the rail member 36 may nest with each other using different methods than those described above.

Figure 27:
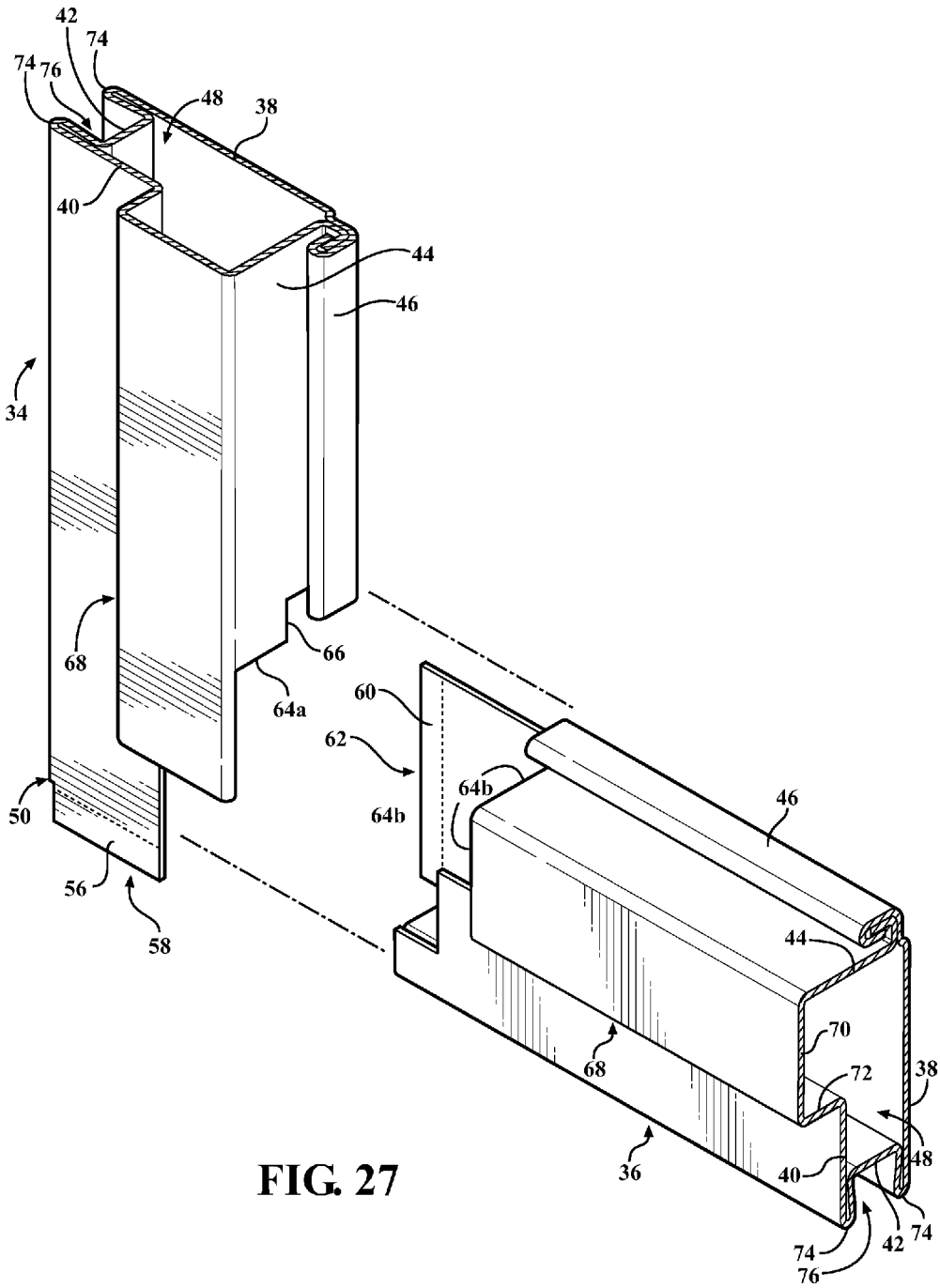
FIG. 27 is a perspective view of a portion of the frame assembly of FIG. 18 showing the stile member spaced from the rail member.

It is to be appreciated that when the flange 46 is present, an aperture 66 may be formed in and defined by the inner fastening wall 44 of the stile member 34 for allowing the flange 46 of the rail member 36 to be disposed within the interior 48 of the stile member 34, as shown in FIG. 27. Alternatively, the flange 46 of the rail member 36 may simply abut the flange 46 of the stile member 34. It is to be appreciated that both the flange 46 of the stile member 34 and the flange 46 of the rail member 36 may be mitered for allowing the flange 46 of both the stile member 34 and the rail member 36 to abut each other.

Figure 18:
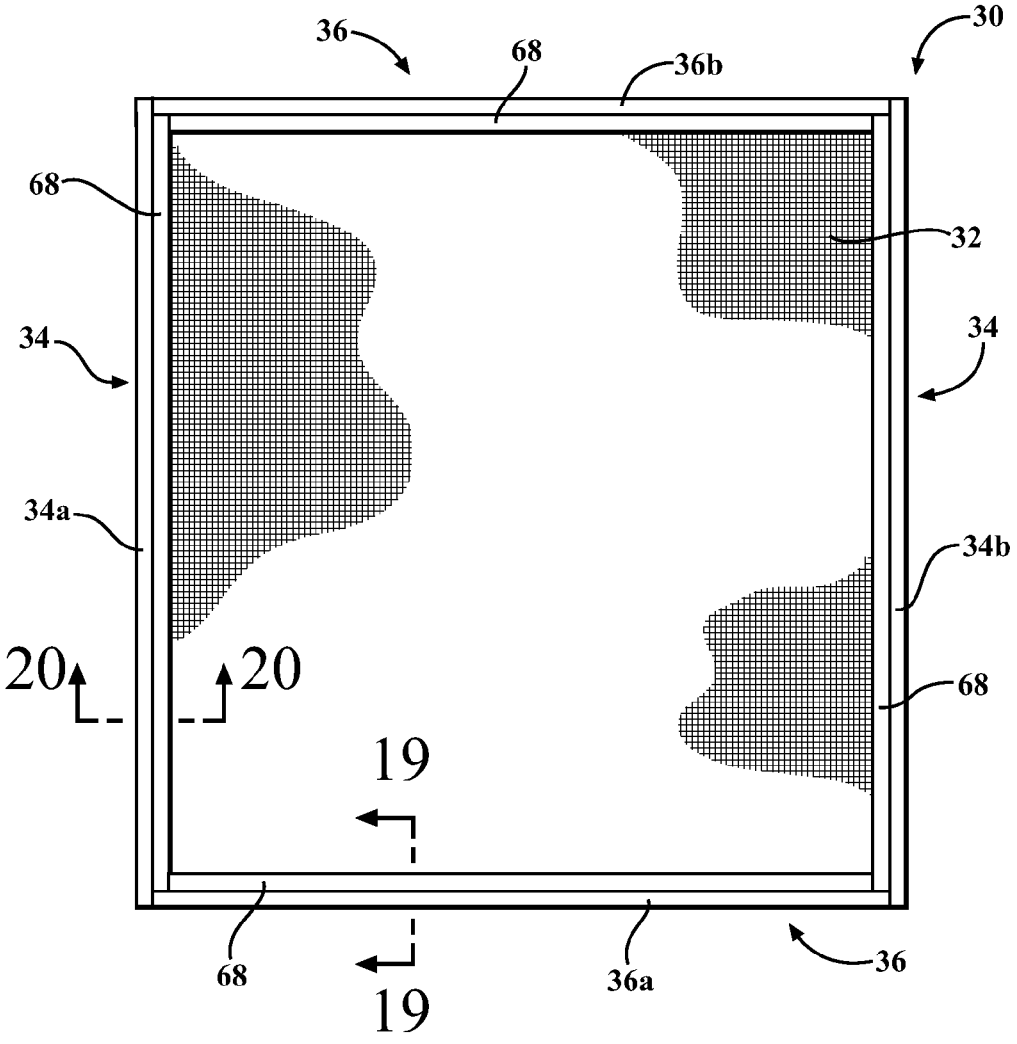
FIG. 18 is a front view of a frame assembly having a protruding body extending from the interior wall of both the stile member and the rail member.
Figure 19:
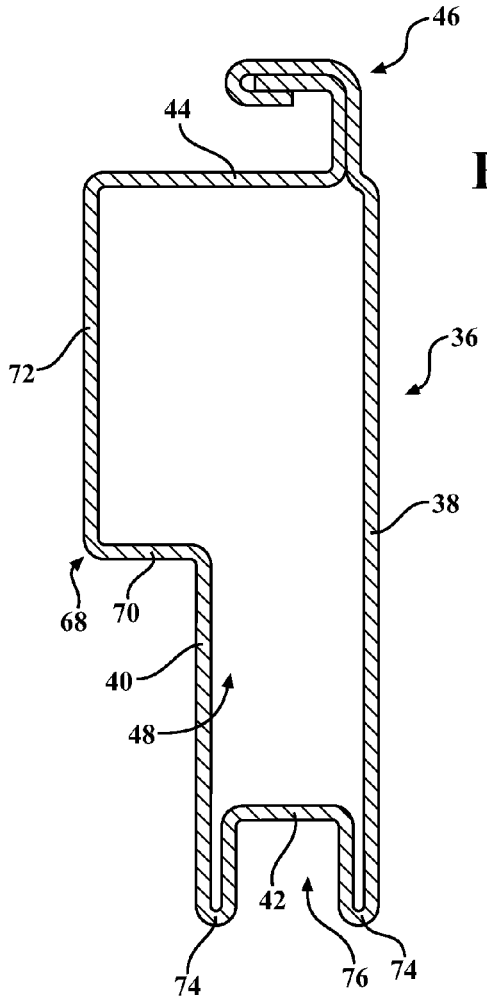
FIG. 19 is a cross-sectional view of the rail member having the protruding body taken along line 19-19 of FIG. 18.
Figure 20:
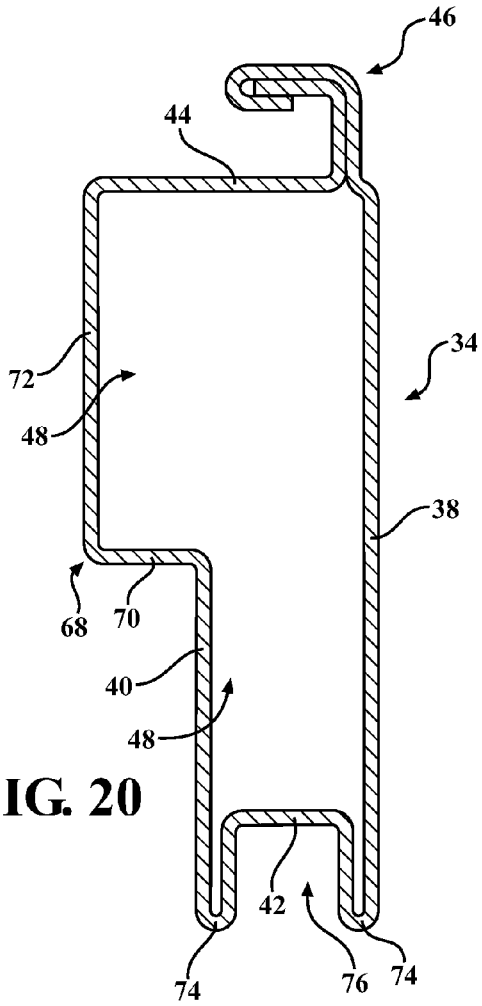
FIG. 20 is a cross-sectional view of the stile member having the protruding body taken along line 20-20 of FIG. 18.

With reference to FIGS. 18-20, each of the stile member 34 and the rail member 36 may further include a protruding body 68. Generally, the presence of the protruding body 68 does not affect the above description of the stile tab 56 or the rail tab 60. The protruding body 68 provides additional strength and stiffness to the stile member 34 and the rail member 36. Additionally, the protruding body 68 allows for a mortise handle while still being able to fit narrow industry standard frame guides. The protruding body 68 has a rectangular cross-section and typically extends from the interior wall 40 of each of the stile member 34 and the rail member 36. It is to be appreciated that the protruding body 68 may extend from the exterior wall 38 of each of the stile member 34 and the rail member 36. The protruding body 68 of each of the stile member 34 and the rail member 36 includes a projecting wall 70 extending from and traverse to the interior wall 40. The protruding body 68 of each of the stile member 34 and the rail member 36 also includes an intermediate wall 72 extending from and traverse to the projecting wall 70. The intermediate wall 72 is spaced from and substantially parallel to the interior wall 40 and is coupled to the inner fastening wall 44. Said differently, the intermediate wall 72 is spaced from the interior wall 40 by the projecting wall 70 and extends between the projecting wall 70 and the inner fastening wall 44.

Figure 21:
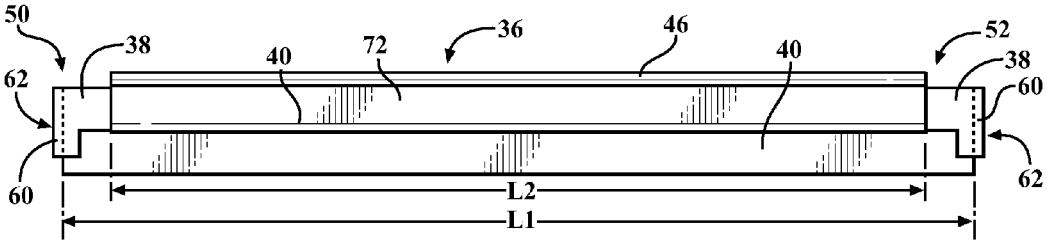
FIG. 21 is a front view of the rail member of FIG. 18 having the protruding body.
Figure 22:
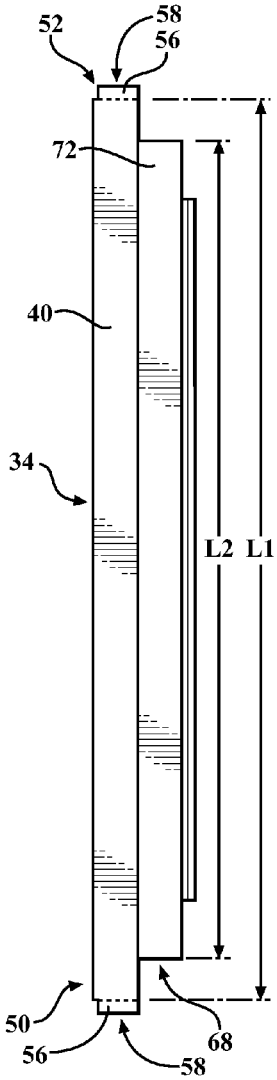
FIG. 22 is a front view of the stile member of FIG. 18 having the protruding body.
Figure 23:
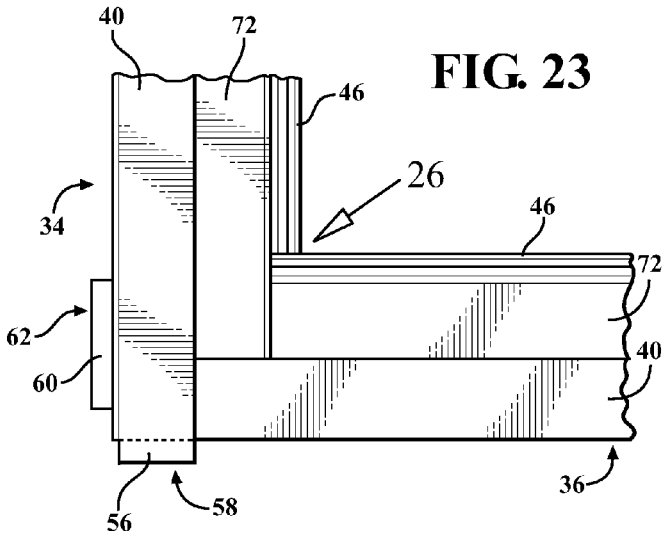
FIG. 23 is a front view of a portion of the frame assembly of FIG. 18 showing the stile member coupled to the rail member with the stile tab extending beyond the rail member and the rail tab extending beyond the stile member.
Figure 26:
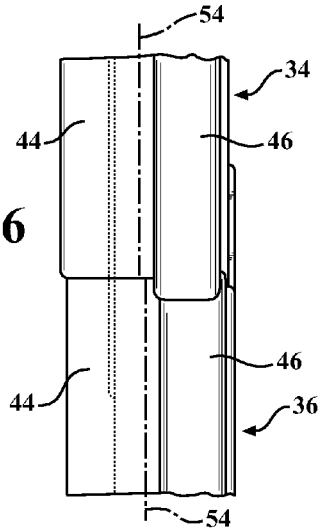
FIG. 26 is a view of a portion of the frame assembly taken in the direction of arrow 26 of FIG. 23 showing a centerline of an inner fastening surface of the stile member that is offset from a centerline of an inner fastening surface of the rail member.
Figure 24:
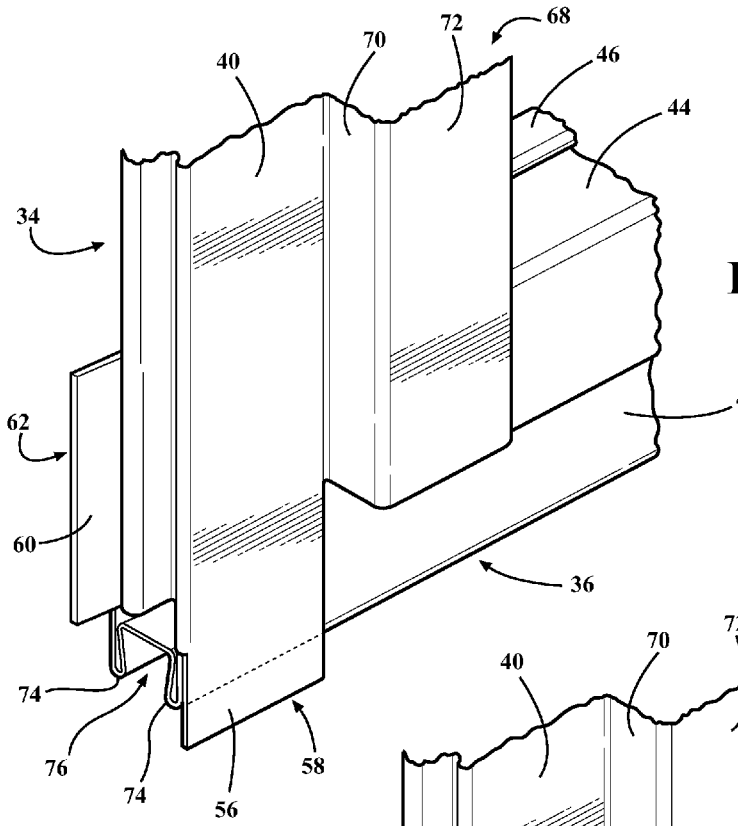
FIG. 24 is a perspective view of a portion of the frame assembly of FIG. 18 showing the stile member coupled to the rail member with the stile tab extending beyond the rail member and the rail tab extending beyond the stile member.
Figure 25:
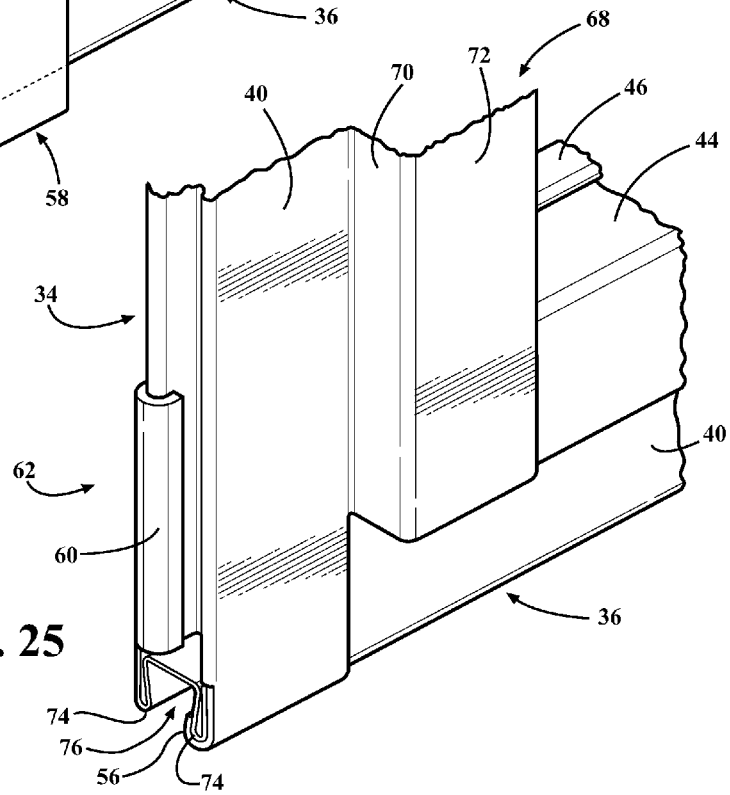
FIG. 25 is a perspective view of a portion of the frame assembly of FIG. 18 showing the stile tab of the stile member bent around the interior wall of the rail member and the rail tab of the rail member bent around the exterior wall of the stile member.

With reference to FIGS. 21 and 22, a length L2 of the protruding body 68 is less than the length L1 of the stile member 34 and the rail member 36. With reference to FIGS. 23 and 24, even when the protruding body 68 is present, the stile tab 56 extends beyond the rail member 36 and the rail tab 60 extends beyond the stile member 34. Additionally, with reference to FIG. 25, the stile tab 56 is bent around the interior wall 40 of the rail member 36 and the rail tab 60 is bent around the exterior wall 38 of the stile member 34 even when the protruding body 68 is present. Furthermore, with reference to FIG. 26, the centerline of the inner fastening wall 44 of both the stile member 34 and the rail member 36 are offset from each other when the stile member 34 is coupled with the rail member 36.

Figure 28:
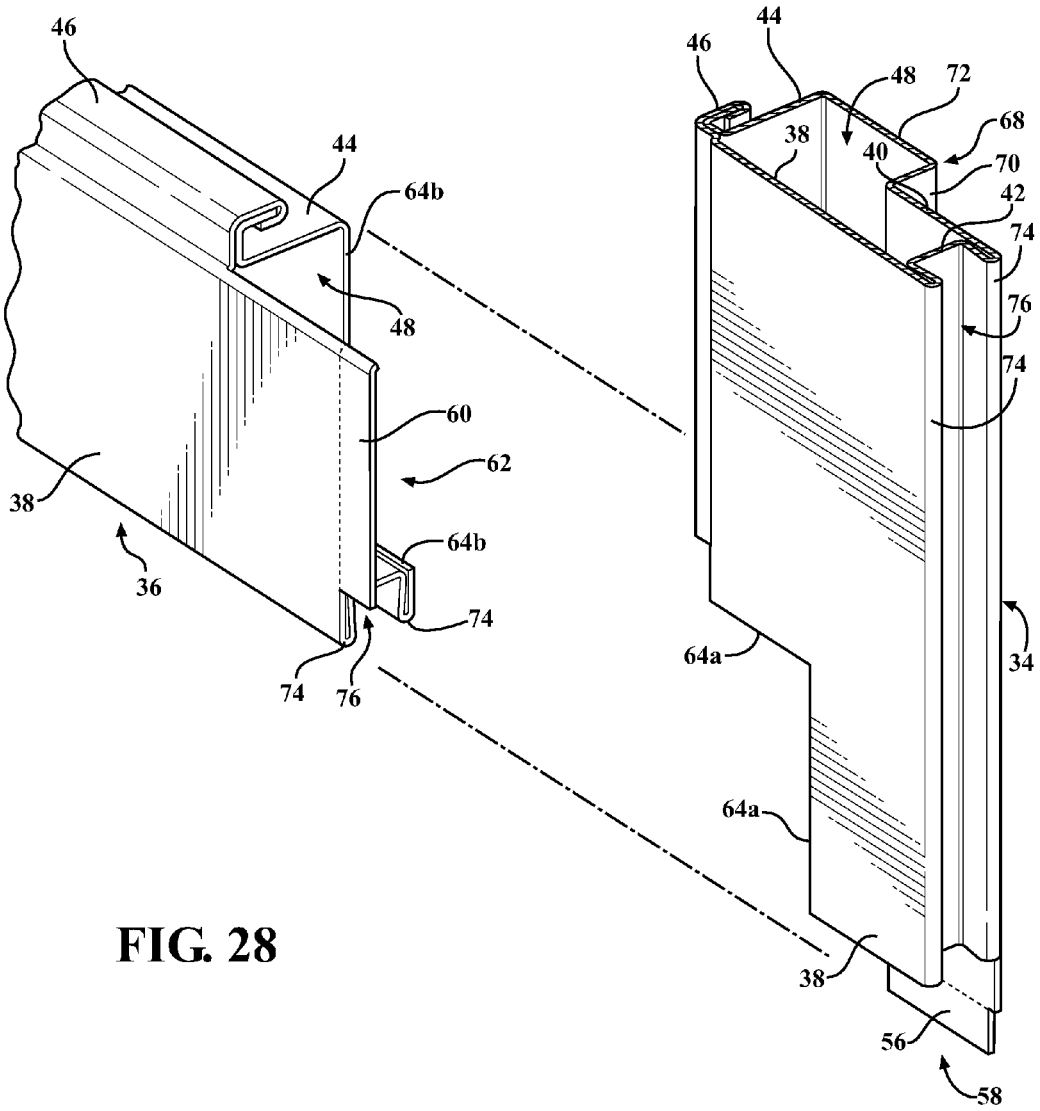
FIG. 28 is another perspective view of a portion of the frame assembly of FIG. 18 showing the stile member spaced from the rail member.

With reference to FIGS. 27 and 28, when the protruding body 68 is present, the inner fastening wall 44, the exterior wall 38, and the protruding body 68 of the stile member 34 defines the first notch 64A and the inner fastening wall 44 and the protruding body 68 of the rail member 36 define the second notch 64B. As such, the method of manufacturing the frame assembly 30 may include the step of forming the first notch 64A defined by the inner fastening wall 44, the exterior wall 38, and the protruding body 68 of the stile member 34 to allow the rail member 36 to be inserted into the stile member 34. Additionally, the method may include the step of forming the second notch 64B defined by the inner fastening wall 44 and the protruding body 68 of the rail to allow the stile member 34 to be inserted into the rail member 36.

As described above, the first notch 64A and the second notch 64B allow the stile member 34 and the rail member 36 to nest with each other. More specifically, when the protruding body 68 is present and the stile member 34 and the rail member 36 are coupled together, a portion of the exterior wall 38 of the stile member 34 is disposed within the interior 48 of the rail member 36 and a portion of the interior wall 40 and a portion of the protruding body 68 of the rail member 36 is disposed within the interior 48 of the stile member 34 for nesting the stile member 34 and the rail member 36 with each other.

With reference to FIGS. 2, 3, 19 and 20, the outer wall 42 of each of the stile member 34 and the rail member 36 may have a pair of legs 74 extending from the outer wall 42 to define a U-shaped channel 76. Typically, the interior wall 40 and the exterior wall 38 of each of the stile member 34 and the rail member 36 extend beyond the outer wall 42 to define the U-shaped channel 76. It is to be appreciated that the U-shaped channel 76 may be integrally formed with or a discrete component of the stile member 34 and the rail member 36. When the U-shaped channel 76 is present, the stile tab end 58 is disposed within the U-shaped channel 76 of the rail member 36 and the rail tab end 62 is disposed within the U-shaped channel 76 of the stile member 34 to further secure the stile member 34 and the rail member 36 to each other.

Generally, the frame assembly 30 may be slidable along a track with the U-shaped channel 76 in communication with the track for guiding the frame assembly 30 between an open and a closed position. The outer wall 42 of the rail member 36 may define a slot for receiving a roller for assisting with sliding the frame assembly 30 between the open and closed positions.

As indicated above, only one stile member 34 and one rail member 36 has been described in detail above. It is to be appreciated that the above description applies to both the first and second stile members 34A, 34B as well as to both the first and second rail members 36A, 36B. Additionally, it is to be appreciated that the method of coupling the rail member 36 to the stile member 34 described above is similar regardless of whether the rail member 36 is coupled to either the first end 50 or the second end 52 of the stile member 34.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A frame assembly for supporting a fenestration article, said frame assembly comprising:

a stile member having an exterior wall and an interior wall opposite said exterior wall;

a rail member coupled substantially transverse to said stile member with said rail member having an exterior wall and an interior wall opposite said exterior wall of said rail member;

a stile tab extending axially from an end of said stile member and planar with said interior wall of said stile member; and a rail tab extending axially from an end of said rail member and planar with said exterior wall of said rail member;

wherein said stile tab is bent around said interior wall of said rail member for coupling said stile member to said rail member;

wherein said rail tab is bent around said exterior wall of said stile member for coupling said rail member to said stile member;

wherein each of said stile member and said rail member further include an outer wall and an inner fastening wall opposite said outer wall with each of said outer wall and said inner fastening wall disposed between said interior wall and said exterior wall, wherein said outer wall, said inner fastening wall, said interior wall, and said exterior wall define a cross-section having a general rectangular configuration; and wherein a notch is defined by at least said inner fastening wall and said exterior wall of said stile member with a portion of said rail member disposed within an interior of said stile member.

2. A frame assembly as set forth in claim 1 wherein said stile tab extends beyond said outer wall of said rail member and said rail tab extends beyond said outer wall of said stile member.

3. A frame assembly as set forth in claim 1 wherein said inner fastening wall of each of said stile member and said rail member define a centerline, which extends along a length of said stile member and said rail member and wherein said stile member and said rail member are coupled together with said centerline of said stile member offset from said centerline of said rail member.

4. A frame assembly as set forth in claim 1 wherein said inner fastening wall of each of said stile member and said rail member define a centerline, which extends along a length of said stile member and said rail member and wherein said stile member and said rail member are coupled together with said centerline of said stile member offset from said centerline of said rail member.

5. A frame assembly as set forth in claim 1 wherein a first notch is defined by at least said inner fastening wall of said stile member and a second notch is defined by at least said inner fastening wall of said rail member with a portion of said stile member disposed within an interior of said rail member and with a portion of said rail member disposed within an interior of said stile member.

6. A frame assembly as set forth in claim 5 wherein said inner fastening wall of each of said stile member and said rail member define a centerline, which extends along a length of said stile member and said rail member and wherein said stile member and said rail member are coupled together with said centerline of said stile member offset from said centerline of said rail member.

7. A frame assembly as set forth in claim 1 wherein each of said stile member and said rail member further include a protruding body having a rectangular cross-section extending from said interior wall.

8. A frame assembly as set forth in claim 7 wherein said protruding body of each of said stile member and said rail member includes a projecting wall extending from and traverse to said interior wall and an intermediate wall extending from and traverse to said projecting wall with said intermediate wall spaced from and substantially parallel to said interior wall and coupled to said inner fastening wall.

9. A frame assembly as set forth in claim 8 wherein said inner fastening wall, said exterior wall, and said protruding body of said stile member define a first notch and wherein said inner fastening wall and said protruding body of said rail member define a second notch with said first notch and said second notch allowing said stile member and said rail member to nest with each other.

10. A frame assembly as set forth in claim 9 wherein a portion of said exterior wall of said stile member is disposed within an interior of said rail member and wherein a portion of said interior wall and a portion of said protruding body of said rail member is disposed within an interior of said stile member for nesting said stile member and said rail member with each other.

11. A frame assembly as set forth in claim 10 wherein said inner fastening wall of each of said stile member and said rail member define a centerline, which extends along a length of said stile member and said rail member and wherein said stile member and said rail member are coupled together with said centerline of said stile member offset from said centerline of said rail member.

12. A frame assembly as set forth in claim 1 further comprising a flange coupled to and extending from said inner fastening wall of each of said stile member and said rail member for receiving the fenestration article to couple the fenestration article to said frame assembly.

13. A frame assembly as set forth in claim 12 wherein said inner fastening wall of said stile member defines a aperture for allowing a portion of said flange of said rail member to be disposed within said stile member.

14. A frame assembly as set forth in claim 1 wherein said outer wall of each of said stile member and said rail member have a pair of legs extending from said outer wall to defining a U-shaped channel.

15. A frame assembly as set forth in claim 14 wherein each of said stile tab and said rail tab have an end with said end of said stile tab disposed within said U-shaped channel of said rail member and with said end of said rail tab disposed within said U-shaped channel of said stile member to further secure said stile member and said rail member to each other.

16. A frame assembly as set forth in claim 1 wherein said inner fastening wall of each of said stile member and said rail member define a centerline, which extends along a length of said stile member and said rail member and wherein said stile member and said rail member are coupled together with said centerline of said stile member offset from said centerline of said rail member.

17. A frame assembly for supporting a fenestration article, said frame assembly comprising:

a stile member having an exterior wall and an interior wall opposite said exterior wall;

a rail member coupled substantially transverse to said stile member with said rail member having an exterior wall and an interior wall opposite said exterior wall of said rail member;

a stile tab extending axially from an end of said stile member and planar with said interior wall of said stile member; and a rail tab extending axially from an end of said rail member and planar with said exterior wall of said rail member;

wherein said stile tab is bent around said interior wall of said rail member for coupling said stile member to said rail member;

wherein said rail tab is bent around said exterior wall of said stile member for coupling said rail member to said stile member;

wherein each of said stile member and said rail member further include an outer wall and an inner fastening wall opposite said outer wall with each of said outer wall and said inner fastening wall disposed between said interior wall and said exterior wall, wherein said outer wall, said inner fastening wall, said interior wall, and said exterior wall define a cross-section having a general rectangular configuration; and wherein a notch is defined by at least said inner fastening wall and said interior wall of said rail member with a portion of said stile member disposed within an interior of said rail member.

18. A frame assembly for supporting a fenestration article, said frame assembly comprising:

a stile member having an exterior wall and an interior wall opposite said exterior wall;

a rail member coupled substantially transverse to said stile member with said rail member having an exterior wall and an interior wall opposite said exterior wall of said rail member;

a stile tab extending axially from an end of said stile member and planar with said interior wall of said stile member; and a rail tab extending axially from an end of said rail member and planar with said exterior wall of said rail member;

wherein said stile tab is bent around said interior wall of said rail member for coupling said stile member to said rail member;

wherein said rail tab is bent around said exterior wall of said stile member for coupling said rail member to said stile member;

wherein each of said stile member and said rail member further include an outer wall and an inner fastening wall opposite said outer wall with each of said outer wall and said inner fastening wall disposed between said interior wall and said exterior wall, wherein said outer wall, said inner fastening wall, said interior wall, and said exterior wall define a cross-section having a general rectangular configuration;

wherein said outer wall of each of said stile member and said rail member have a pair of legs extending from said outer wall to defining a U-shaped channel; and wherein each of said stile tab and said rail tab have an end with said end of said stile tab disposed within said U-shaped channel of said rail member and with said end of said rail tab disposed within said U-shaped channel of said stile member to further secure said stile member and said rail member to each other.

* * * * *